United States Patent [19]

Maust

[11] 3,999,401

[45] Dec. 28, 1976

[54] WATER DEFLECTOR SHIELD FOR A WATER PUMP AND MOTOR ASSEMBLY

[75] Inventor: Sylvester L. Maust, Bellbrook, Ohio

[73] Assignee: General Motors Corporation, Detroit, Mich.

[22] Filed: July 17, 1975

[21] Appl. No.: 596,585

[52] U.S. Cl. ..... 62/347; 417/423 R; 415/170 A; 62/348

[51] Int. Cl.[2] ..... F25C 1/00

[58] Field of Search ..... 62/347, 348; 417/423 R; 415/170 A

[56] References Cited

UNITED STATES PATENTS

| | | | |
|---|---|---|---|
| 2,784,563 | 3/1957 | Baker | 62/347 |
| 2,806,357 | 9/1957 | Pichler | 62/347 |
| 2,887,852 | 5/1959 | Thomas | 62/348 |
| 2,957,711 | 10/1960 | Aspelin | 415/170 A |
| 3,080,726 | 3/1963 | Tenniswood | 62/347 |
| 3,580,008 | 5/1971 | Barnard | 62/347 |
| 3,760,600 | 9/1973 | Matsui et al. | 62/348 |
| 3,826,589 | 7/1974 | Frank et al. | 415/170 A |
| 3,871,796 | 3/1975 | Mack | 415/170 A |
| 3,914,072 | 10/1975 | Rowley et al. | 417/423 R |

*Primary Examiner*—William E. Wayner
*Assistant Examiner*—Henry C. Yuen
*Attorney, Agent, or Firm*—J. C. Evans

[57] ABSTRACT

A water pump assembly for use with a slab type commercial ice maker of the type having an ice storage bin cavity at the bottom thereof and further having an inclined refrigerated plate and water recirculation pump system located within an ice maker compartment wherein the pump is submerged in the low point of a reservoir having a water surface therein directly exposed to the bin storage cavity to collect water recirculated across the refrigerated plate, the pump supplying water to the refrigerated plate and including an impeller shaft directed vertically therefrom through a shaft seal assembly coaxially located with respect to a bearing assembly in a motor for driving the impeller; a cup shaped deflector having an open end is supported on the pump housing and a cover thereon has an opening for the impeller shaft at a point interposed between the seal assembly and the bearing assembly so as to intercept spray from a pump shaft seal leak to prevent impingement thereof against the bearing assembly and to restrict the spray to the vicinity of the pump to prevent passage of the spray into the ice storage bin cavity.

1 Claim, 5 Drawing Figures

WATER DEFLECTOR SHIELD FOR A WATER PUMP AND MOTOR ASSEMBLY

This invention relates to slab type ice makers having a water recirculation pump located in the low point of a water reservoir and including a motor driven impeller drive shaft having flinger rings thereon for centrifugally diverting pump shaft seal leaks and more particularly to an improved deflector arrangement for containing pump seal spary leaks to the vicinity of a pump motor housing and water reservoir.

Water pump systems for use in slab type commercial ice makers include a water recirculation pump located in the low point of an open surfaced water reservoir. Such pumps have an inlet located below the water level and a side outlet connected to a conduit for directing water to a refrigerated plate assembly. In such arrangements, an impeller drive shaft is directed vertically of the pump through a shaft seal assembly and is coupled at its upper end to a drive motor having a bearing assembly located in spaced axial relationship to the shaft seal. Such systems often are subject to shaft seal leakage. Since the pump is located in a reservoir having its upper water surface open to the ice making compartment normally small shaft seal leaks are compensated by return of the water flow directly to the reservoir without adversely affecting operation of the machine. However, it is recognized that even small shaft leaks can migrate along the vertically disposed shaft and impinge against the motor bearing assembly. Accordingly, flinger rings are located on the impeller drive shaft at a point spaced vertically from the pump housing to intercept leakage migration on the shaft and fling it radially outwardly from the shaft to prevent moisture from entering the drive motor bearing.

While such arrangements are suitable for their intended purpose it has been observed that shaft seal leaks may produce a substantial spray pattern that will impinge against the underside of the motor and the shaft bearing assembly thereon. Furthermore, such spray patterns may pass from the vicinity of the motor pump housing and reservoir directly into the bin storage cavity with a resultant wetting of the individual cube particles therein which can cause them to adhere together and to be melted away by the water spray.

An object of the present invention, therefore, is to improve slab type ice makers having pump assemblies with a vertically directed impeller shaft sealed at one end thereof by a shaft seal assembly and coupled at the other end thereof to a drive motor with a shaft bearing assembly located in vertically spaced axial alignment with the shaft seal and wherein the shaft seal is directly exposed to a bin storage cavity by the provision therein of an improved deflector member having an open end supported on the upper surface of the pump housing immediately above the upper surface of the water level in a reservoir and wherein the deflector member includes a cover with an opening through which the impeller shaft is directly located at a point interposed between the shaft seal assembly and the bearing assembly to intercept spray from water leakage across the shaft seal assembly to prevent impingement on the bearing assembly and to return the spray pattern into the vicinity of the upper surface of the pump housing and within the boundaries of the water reservoir and wherein the diverter includes a weep hole therein located at the upper surface of the pump to drain spray leakage from the shaft seal assembly back into the reservoir at the upper surface of the water level to prevent it from passing directly into the ice storage cavity.

Still another object of the present invention is to improve a slab type ice maker wherein a water recirculation pump is located at the low point in a reservoir for circulation of water across an inclined refrigerated plate located inside an ice maker compartment having an ice bin storage cavity located immediately below the reservoir and wherein the upper surface of the reservoir is directly exposed to the storage cavity with the pump having its inlet submerged below the upper surface of the water level in the reservoir and including an outlet fitting thereon coupled to a conduit for supplying water to the refrigerated plate and further having a vertically directed impeller drive shaft directed through a shaft seal assembly at one end thereof and coupled to a drive motor at the opposite end thereof and wherein the pump shaft seal assembly is susceptible to spray leakage therefrom; by the provision of an inverted cup shaped deflector located in surrounding relationship to the shaft having a first horizontal wall portion thereon located to intercept vertically directed spray patterns from the shaft seal assembly to prevent impingement thereof against a drive motor bearing assembly on the underside of the drive motor and including a second peripheral wall portion thereon to intercept generally horizontally directed spray patterns from the seal assembly to prevent passage thereof directly into the ice storage cavity with resultant freezing together and melting of individual ice particles therein thereby to reduce energy waste in producing replacement ice for that melted and further to reduce waste of potable water which is removed from the drain in the ice storage cavity and further to reduce machine run time required to cool additional make-up for that lost through the drain.

Further objects and advantages of the present invention will be apparent from the following description, reference being had to the accompanying drawings wherein a preferred embodiment of the present invention is clearly shown.

Figure 1:
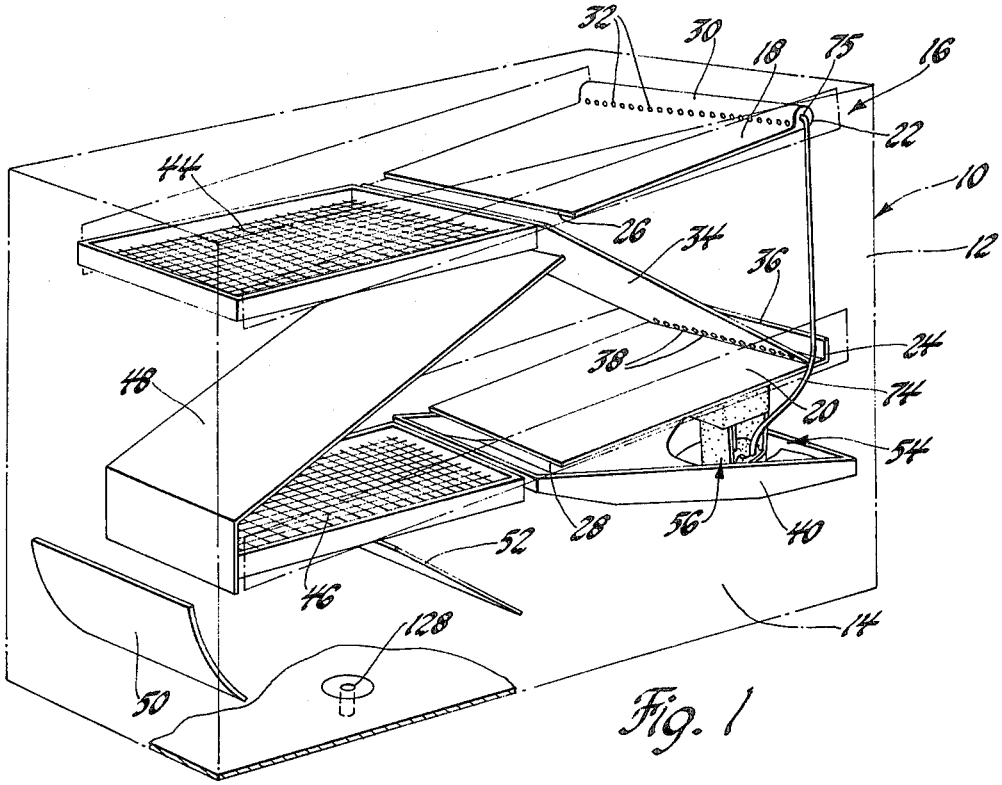
FIG. 1 is a diagrammatic view of a slab type ice maker including the present invention.

Referring now to the drawing, in FIG. 1, a slab type ice maker 10 is illustrated including an ice maker housing 12 with an ice bin storage cavity 14 therein located below an ice maker assembly 16. The ice maker assembly 16 is representative of those found in slab type commercial ice makers and includes a pair of refrigerated plate assemblies 18, 20 each associated with a refrigeration system of the type shown in U.S. Pat. No. 2,887,852 issued May 26, 1959, to W. M. Thomas. Each of the plate assemblies 18, 20 is located in an upper part of the ice maker housing 12 and each includes an upper edge portion 22, 24, respectively, which is located vertically above a lower edge portion 26, 28 formed respectively on the plates 18, 20. Each of the plate assemblies 18, 20 is associated with evaporator coils (not shown) through which refrigerant is directed from known ice maker refrigerant systems to cool the inclined plate assemblies 18, 20 to below freezing temperatures.

Figure 2:
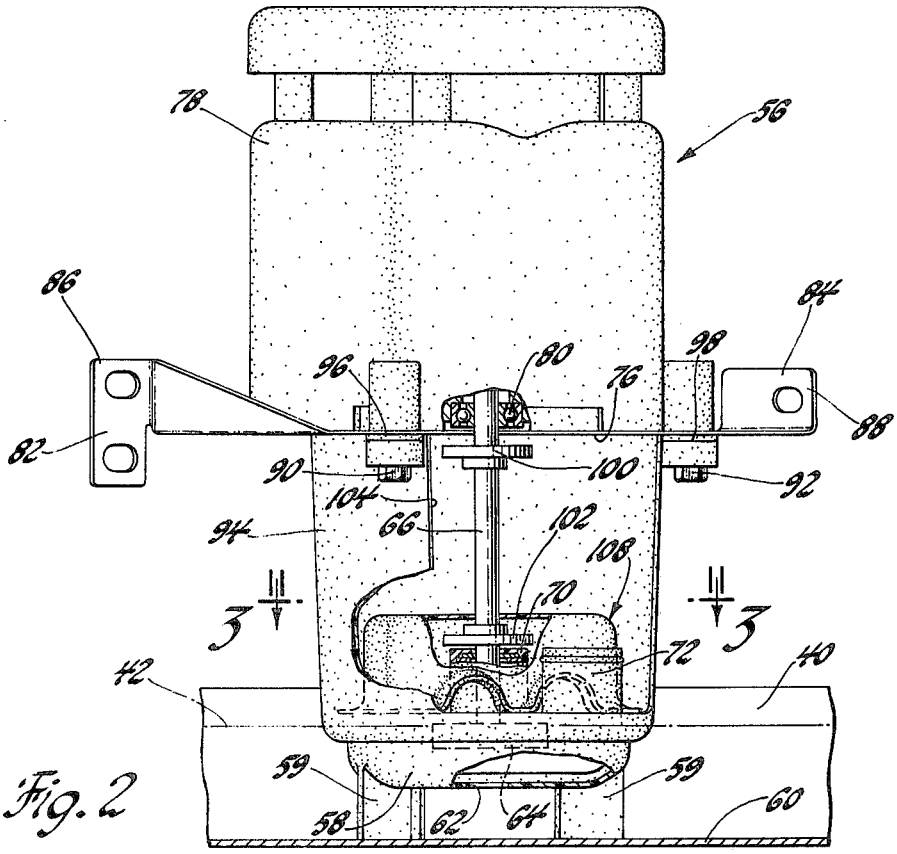
FIG. 2 is a side elevational view partially broken away of a motor pump assembly including the present invention.
Figure 3:
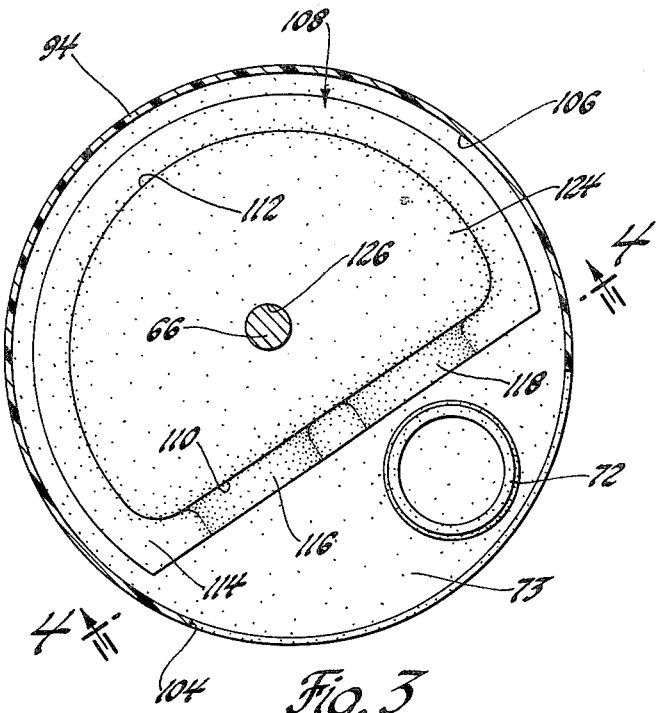
FIG. 3 is a horizontal sectional view taken along the line 3—3 of FIG. 2 looking in the direction of the arrows.
Figure 4:
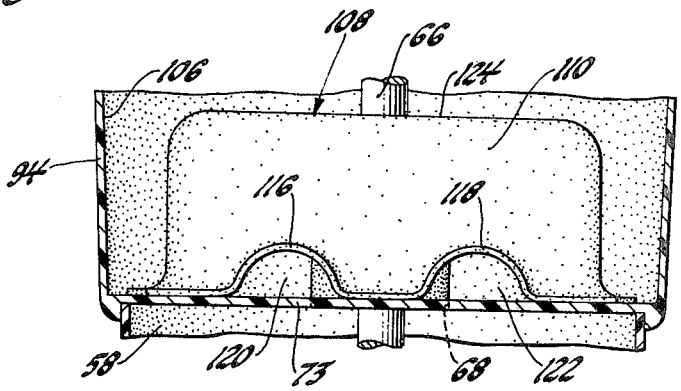
FIG. 4 is a vertical sectional view taken along the lines 4—4 of FIG. 3 looking in the direction of the arrows.
Figure 5:
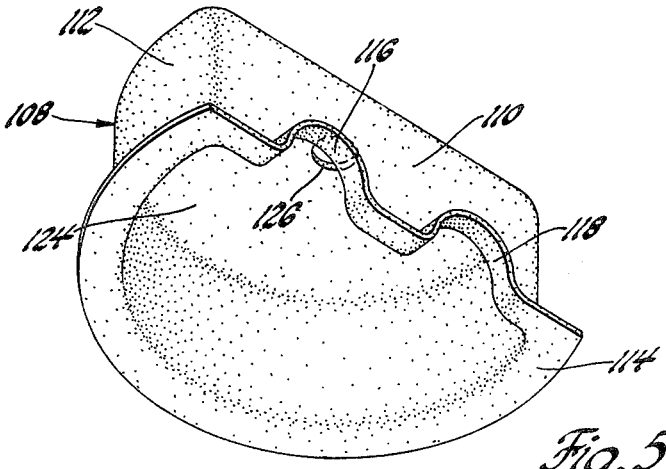
FIG. 5 is a perspective view of the deflector of the present invention.

The upper plate assembly 18 includes a water distributor header 30 thereon having a plurality of water distributing ports 32 located at the upper edge 22 of the plate 18 to flow water across the plate 18 against a return plate 34 that is associated with a trough 36 at the upper end 24 of the plate 20. The plate 34 includes a plurality of openings 38 therein through which water is distributed across the upper surface of the inclined plate 20 for flow to the lower edge 28 thereof. The water thence is returned to the upper end of a reservoir pan 40 located immediately above the ice bin storage cavity 14. The reservoir 40 as best seen in FIG. 2 includes an upper water surface 42 that is open to the ice storage cavity 14. Water level is maintained by suitable means such as the float control system set forth in the aforementioned Thomas patent.

In accordance with known practice, following an ice making cycle of operation slabs of ice that are built up on the inclined plate assemblies 18, 20 are released during a defrost cycle of operation and pass from the inclined plate assemblies onto a pair of electrically energized grid assemblies 44, 46. The grid assembly 44 receives a slab from the plate 18 and is continuously energized to separate the slab into a plurality of individual cubes that fall against a downwardly inclined ice diverter plate 48 and pass therefrom against a chute 50 to be directed into the storage cavity 14. Likewise, the slab of ice on the inclined plate 20 will be freed therefrom during the defrost cycle of operation and pass onto the heated grid assembly 46 for separation into individual cubes which fall against a chute 52 which diverts the ice particles also into the cavity 14.

The present invention is directed to an improved water circulation system 54 which in part includes the upper open ended reservoir pan 40. The water circulation system includes a motor pump assembly 56 located at the low point in the reservoir 40 as shown in FIG. 2. It includes a lower pump housing 58 supported by dependent leg portions 59 on the bottom 60 of the reservoir pan 40. The pump housing 58 includes an inlet opening 62 therein located below the water surface 42 to draw water from the reservoir pan 40. An impeller 64 is located within the pump housing and has a vertically directed impeller shaft 66 connected at one end to the impeller to extend upwardly from the housing 58 through a seal cavity 68 therein. An annular seal assembly 70 located in cavity 68 seals the outer periphery of the shaft 66.

The pump housing 58 further includes a radially offset outlet tube 72 integrally formed with and extending vertically of an upper cover 73 of the pump housing 58. The outlet tube 72 is connected to a flexible supply conduit 74 extending upwardly through the ice making compartment to be connected at its opposite end to the inlet 75 of the header 30 for distributing water as set forth heretofore. In the illustrated arrangement the impeller shaft 66 is directed through the base 76 of a drive motor housing 78. A motor bearing assembly 80 is base 76 supports the shaft 66 as it enters the motor housing 78. The motor housing 78 has a plurality of radially outwardly directed support brackets 82, 84 each of which includes an outer flange portion 86, 88, respectively, for receiving a fastener to secure the brackets 82, 84 to fixed support means (not shown) on the housing 12. The opposite ends of each of the brackets 82, 84 are connected to the motor housing 78 by means of suitable fasteners representatively shown as screw fasteners 90, 92. The drive motor housing 78 is supported on a pedestal above the lower pump housing 58 by means of an upper pump housing member 94 formed as a peripheral flange on the upper cover 73 of the pump housing 58. It includes a plurality of circumferentially radially outwardly directed flanges 96, 98 also secured to the pump motor housing 78 by means of screw fasteners 90, 92.

During machine operation the drive motor is energized to rotate the impeller shaft 66 whereby water is drawn from the reservoir pan 40 through the inlet opening 62 for discharge through the outlet tube 72. In the past, it has been recognized that a low cost seal assembly such as that illustrated at 70 in FIG. 2 may develop slight leaks. Such leaks are isolated from the motor bearing 80, which is located vertically above and in axial alignment with the seal assembly 70, by means of a pair of flinger rings 100, 102 secured to the shaft 66 below the bearing 80. Such flinger rings prevent migration of a slow leak from the seal assembly 70 vertically upwardly along the shaft 66 and cause fluid from such leaks to be radially outwardly directed through a side opening 104 formed in the upstanding flange 96 that forms a pedestal support for the motor housing 78. The quantities of water that migrate vertically along the shaft 66 are such that the flinger rings 100, 102 for the most part will direct them against the inner surface 106 of the flange 94. Such leakage will collect thereon and will pass against the upper cover 73 to be returned to the reservoir water level 42. Thus minor leaks are effectively contained and isolated from the motor bearing assembly 80 and returned to the water level by means which isolate the water leakage to the vicinity of the motor pump assembly 56 and the reservoir pan 40.

However, low cost seals as shown at 70 in FIG. 2 can develop more substantial leaks which take the form of a spray of water which can bypass flinger rings 100, 102 to impinge directly on base 76 and enter bearing assembly 80. Moreover, such spray can be directed through the side opening 104 at sufficient velocity to carry beyond the vicinity of the water reservoir pan 40 into the cavity 14. Such spray patterns can direct a substantial quantity of water into the cavity 14 and this water can cause the individual ice cube particles within the cavity 14 to adhere together in a large mass of ice which must be broken up prior to use. In accordance with the present invention, in addition to the flinger rings 100, 102, a spray deflector 108 is provided at a point interposed between the upper cover 73 of the lower pump housing 58 and the base 76 of the motor housing 78. More particularly, the deflector 108 is configured as an inverted cup shaped element including a side wall portion 110 that is formed along a chord line on the radially inward side of the outlet tube 72. The side wall portion 110 is integrally formed with an arcuate peripheral wall portion 112 that cooperates with the wall portion 110 to form a continuous side wall barrier radially outwardly of the shaft 66. The wall portions 110, 112 have a radially outwardly directed flange 114 formed continuously therearound which rest against the upper surface 73 of the pump housing 58 to support the deflector 108 thereon. The flange 114 includes a pair of convoluted segments 116, 118 thereon defining weep openings 120, 122, respectively, for return of spray leaks from the inside of the deflector 108 across the upper surface 73 of the pump housing to flow smoothly without agitation into the water level present within the reservoir pan 40. The deflector 108 includes an upper cover 124 with an opening 126 therein through which the vertically directed impeller shaft 66 is directed. The upper cover 124 defines a portion on the deflector 108 that intercepts generally vertically directed spray patterns that might develop across the seal assembly 70 to prevent such spray patterns from impinging against the base 76 of the motor housing 78 for subsequent migration into the bearing assembly 80. Likewise, the side wall portions 110, 112 serve to intercept generally horizontally directed spray patterns from the shaft seal assembly 70 to prevent them from passing through the side opening 104 into the ice cavity 14 so as to cause individual ice cube particles therein to adhere.

By virtue of the aforesaid arrangement, a wide range of leak conditions across the low cost seal assembly 70 are effectively isolated from a vertically spaced and aligned bearing assembly 80 of a pedestal supported motor housing 78. Furthermore, the deflector 108 serves to effectively isolate more substantial high velocity spray patterns across the seal assembly 70 to the region of the pump housing 58 and the reservoir pan 40 through a return drainage pattern that will produce little or no agitation of the water surface 42. Since the spray patterns are contained and isolated into the vicinity of the pump housing 56 and the reservoir pan 40, the bearing assembly 80 is protected and the ice quality of individual cubes in the bin 14 is maintained.

To summarize, the water deflector shield 108 of the present invention prevents wetting of individual ice particles to prevent adhesion therebetween. Further, it prevents the ice particles from being melted away by the water spray, particularly during machine operation modes wherein incoming supply water is being cooled down by passage across the refrigerated plate assemblies 18, 20. Such operation results in a percentage wasting of the stored ice quantity, waste of energy to produce the ice wasted, waste of potable water as the result of the spray of water into the storage bin area, which is lost to the drain 128 and additional running time to produce a given slab thickness of ice considering additional make up water that must be cooled and is lost during recirculation due to the spray from the pump area.

While the embodiments of the present invention, as herein disclosed, constitute a preferred form, it is to be understood that other forms might be adopted.

What is claimed is:

1. In a slab type ice maker of the type including an inclined, refrigerated plate assembly and a water recirculation system located within an ice maker cabinet having an ice storage bin cavity therein and wherein the water recirculation system includes a reservoir exposed to the bin storage cavity and having a pump located at its low point with its inlet submerged in the reservoir for drawing water therefrom for discharge across the refrigerated plate assembly during an ice making cycle of operation and wherein the pump is driven by a pedestal mounted drive motor located thereabove with a shaft bearing therein located vertically above an impeller shaft seal having an impeller drive shaft directed therethrough in a vertical direction to be rotatably supported by the shaft bearing, the improvement comprising: an upper pump housing cover with a peripheral flange thereon upstanding from the pump housing to the underside of the drive motor, said peripheral flange including a side opening therein in overlying relationship to the water reservoir for drainage of water leakage from the shaft seal to the reservoir, a cup-shaped shaft seal spray deflector having a cover thereon and a side wall portion defining an open ended base, said cover having a shaft opening therein through which the impeller shaft is directed, said cover being located at a point interposed between the pump shaft seal and the motor bearing and in spaced relationship to the pump shaft seal to intercept vertical spray from a shaft seal leak to divert the shaft seal spray leak from impingement on the drive motor bearing and to restrict the spray flow to the vicinity of the water pump housing and the pump reservoir without passage thereof into the ice storage bin cavity, said side wall portion intercepting horizontal spray leaks to prevent passage thereof into the ice bin storage cavity, said deflector including a weep hole at the base thereof immediately overlying the upper pump housing cover in alignment with the side opening to allow contained drainage of the spray leakage to the reservoir.

* * * * *